US005743696A

United States Patent [19]

Rossato

[11] Patent Number: 5,743,696

[45] Date of Patent: Apr. 28, 1998

[54] MOTOR VEHICLE PARKING INSTALLATION

[76] Inventor: Eride Rossato, Via Galilei, 20, 30035 Mirano, Italy

[21] Appl. No.: 810,033

[22] Filed: Mar. 4, 1997

Related U.S. Application Data

[62] Division of Ser. No. 620,744, Mar. 18, 1996, Pat. No. 5,622,466, which is a continuation of Ser. No. 365,739, Dec. 29, 1994, abandoned.

[30] Foreign Application Priority Data

Jul. 10, 1992 [IT] Italy ..... PD92A0127

[51] Int. Cl.[6] ..... E04H 6/12

[52] U.S. Cl. ..... 414/228; 414/234; 414/240

[58] Field of Search ..... 414/227–229, 414/233, 234, 239, 240, 242, 249; 187/203, 206, 207, 216, 253, 259, 260

[56] References Cited

U.S. PATENT DOCUMENTS

| | | | |
|---|---|---|---|
| 4,674,938 | 6/1987 | Van Stokes et al. | 414/228 |
| 5,035,562 | 7/1991 | Rosen | 414/240 |
| 5,067,866 | 11/1991 | Fusaro et al. | 414/228 |

FOREIGN PATENT DOCUMENTS

| | | | |
|---|---|---|---|
| 5133125 | 5/1993 | Japan | 414/228 |
| 6158890 | 6/1994 | Japan | 414/227 |
| 2224017 | 4/1990 | United Kingdom | 414/239 |

*Primary Examiner*—James W. Keenan
*Attorney, Agent, or Firm*—Hoffman, Wasson & Gitler

[57] ABSTRACT

A vehicle parking installation is provided having a pair of vertical columns, multiple platforms provided with carriages movable independently of each other along the columns. The carriages are lockable along the columns at predetermined distances which are suitable for accommodating individual vehicles. The platforms may be driven along the columns by a central unit which controls the operation of the installation. A drive member which is applied to each column is controlled by the central unit so that it can releasably connect the drive member to a selected platform to thereby displace the selected platform along the column. Each column has a mechanical locking device spaced at predetermined distances apart, individually controlled by the central unit and movable between an interference position and a non-interference position.

6 Claims, 3 Drawing Sheets

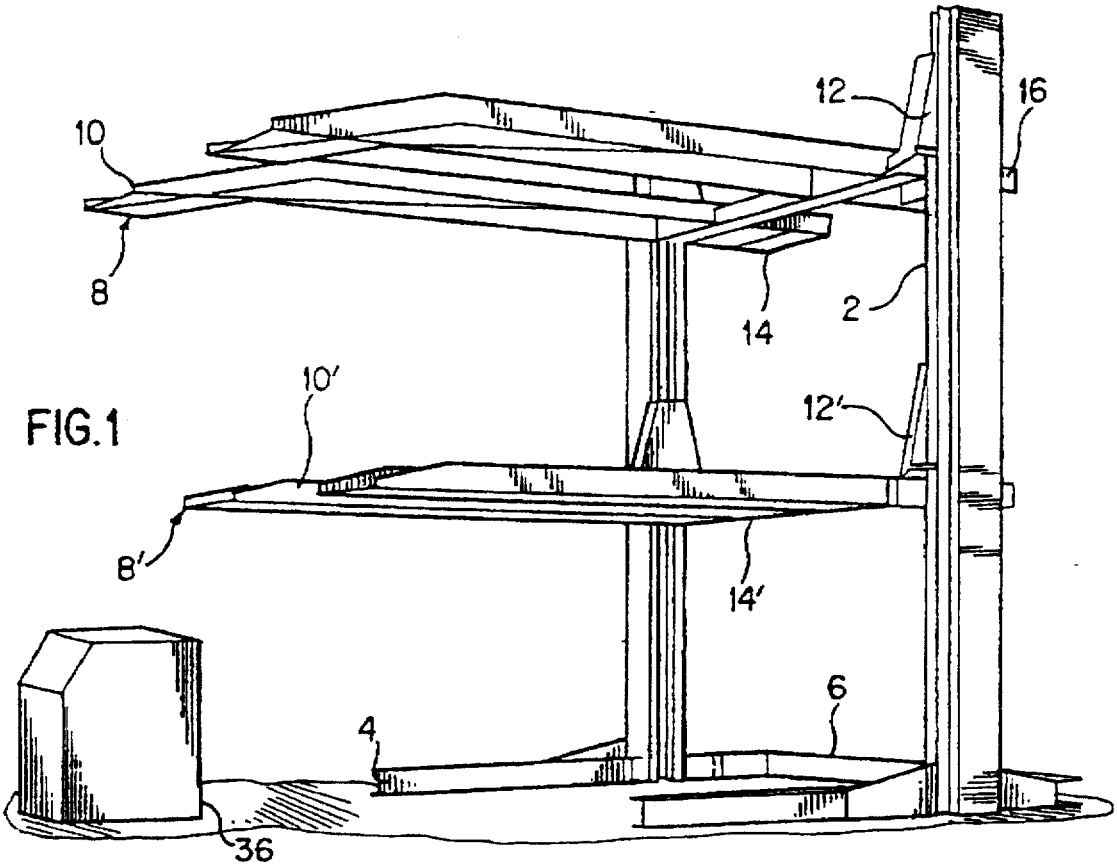
FIG.1
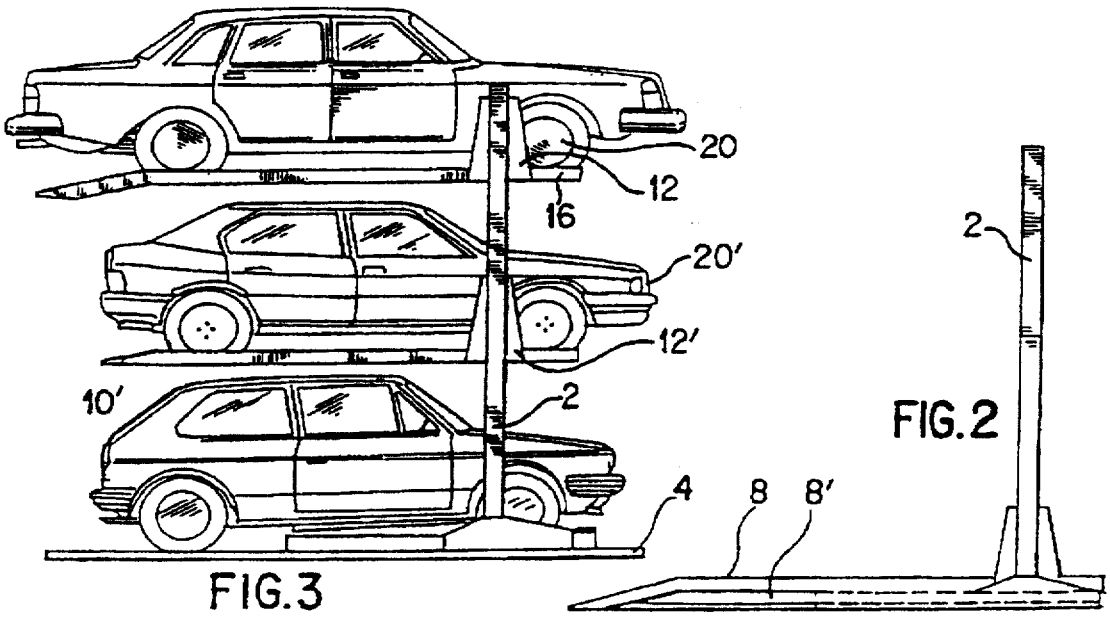
FIG.2
FIG.3

MOTOR VEHICLE PARKING INSTALLATION

This application is a division of Ser. No. 08/620,744 filed Mar. 18, 1996, now U.S. Pat. No. 5,622,466, which is a continuation of Ser. No. 08/365,739 filed Dec. 29, 1994, now abandoned.

FIELD OF THE INVENTION

This invention relates to a vehicle parking installation.

BACKGROUND OF THE INVENTION

Parking installations are known comprising a metal frame containing housings for individual automobiles and a member for transferring said automobiles from an entry station to the individual housings and from these to an exit station, which can coincide with or be separate from the entry station.

Such installations have been proposed based on the most varied sizes, configurations and operating principles, and have not only solved the problem of the intensive parking of a large number of automobiles but have also solved the problem of optimizing the capacity of the installation for the particular space available.

However these known installations have all proved unsuitable for small-scale use, ie in the case of a very small number of automobiles (generally from two to six), in that the various components are not utilized to a satisfactory extent and therefore result in an excessive cost per housing, ie per parking unit.

DESCRIPTION OF THE PRIOR ART

EP-A2-0437014 relates to a tri-levels parking apparatus for vehicles comprising a pair of vertical columns, two platforms slidable along the columns, independently associated for their movement along these to cylinder piston units, and provided with locking means along the same columns at the the desired level. A feeding and control unit is foreseen.

SUMMARY OF THE INVENTION

The object of the invention is to obviate this drawback by providing a vehicle parking installation which solves the problem of small-scale use, ie which is convenient for individual dwellings or small communities in general, for which a traditional automated parking installation would be excessively costly.

This and further aims are attained according to the invention through a vehicle parking installation, comprising a pair of vertical columns, a plurality of platforms provided with carriages movable independently of each other along said columns, and lockable along said columns at predetermined distances suitable for accommodating individual vehicles, means for driving said platforms along said columns, and a central unit for controlling the operating of said installation wherein:

- a member is applied to each column for driving said platform, controlled by said central unit and provided with means for the releasable connection of the member to a selected platform in order to displace said selected platform along said column, and
- each column is provided with mechanical locking means spaced at predetermined distances apart, individually controlled by said central unit and movable between an interference position with the movement of the platforms and non-interference position.

BRIEF DESCRIPTION OF THE DRAWINGS

Two preferred embodiments of the present invention are described hereinafter with reference to the accompanying drawings, in which:

FIG. 1 is a perspective view of a parking installation according to the invention in an empty state;

FIG. 2 is a side view thereof in its rest configuration;

FIG. 3 shows the same side view as FIG. 2, but in its totally filled state;

DESCRIPTION OF PREFERRED EMBODIMENTS

Figure 4:
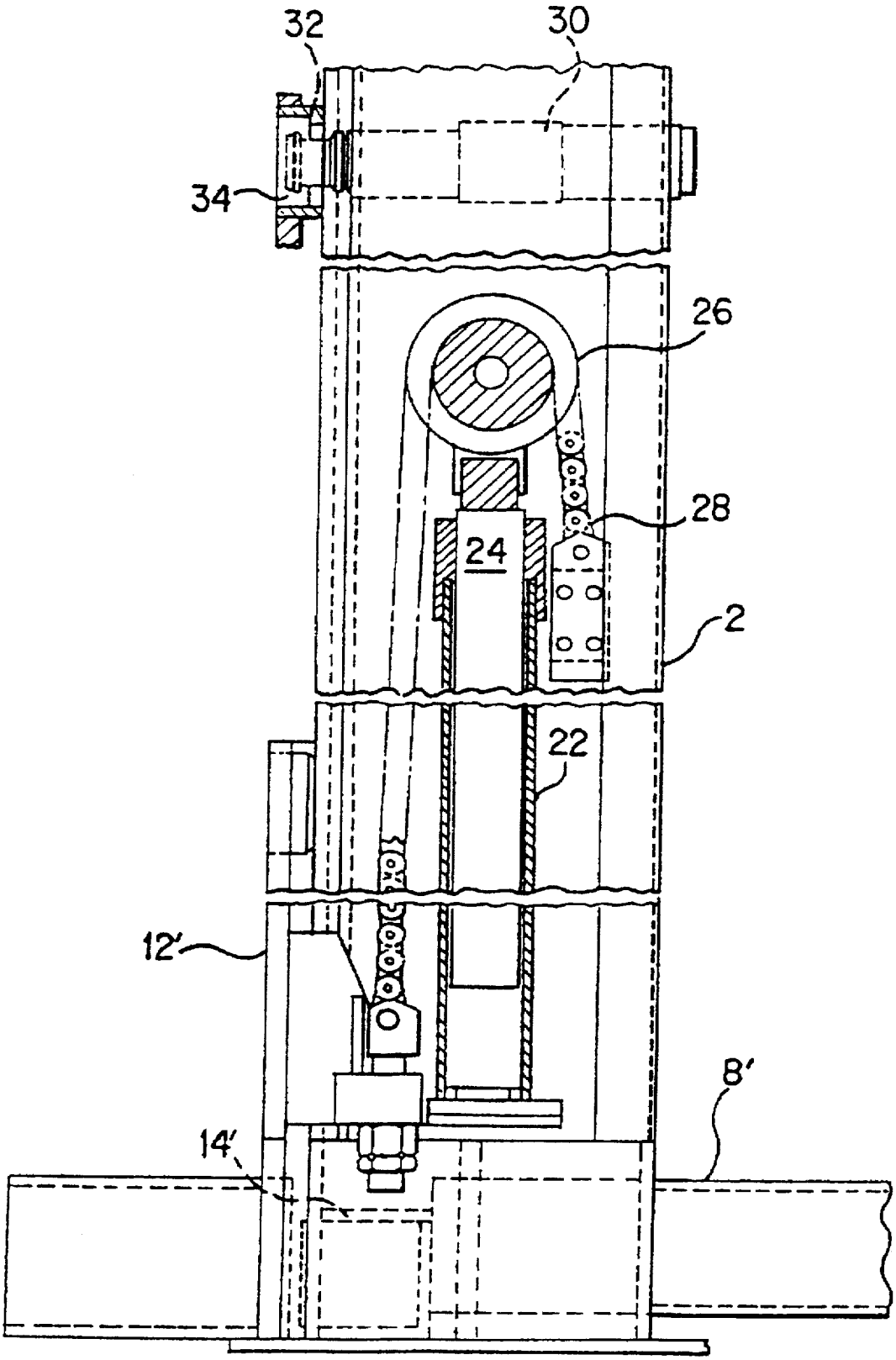
FIG. 4 is an enlarged partial vertical section through a part of a column with a platform raising cylinder-piston unit and a safety cylinder-piston unit.

As can be seen from the figures, the installation according to the invention in the embodiment shown in FIGS. 1 to 4 comprises a pair of columns 2 welded to two longitudinal members 4 and spaced apart by a cross-member 6. In the drawings the longitudinal members 4 and the cross-member 6 simply rest on the ground, but could be fixed to and/or embedded in it, in which case the cross-member 6 could be dispensed with.

Two platforms, namely an upper 8 and a lower 8', can slide independently of each along the columns 2. Both these platforms consist of a pair of runways 10,10' provided with carriages 12,12' for their sliding along the columns and joined together by a connecting cross-member 14,14' positioned substantially in corresponding with said carriages 12,12'.

Each runway 10,10' of the two platforms 8,8' comprises at its rear end, ie the end close to the column 2, a depression 16 which, as will be apparent hereinafter, can receive the corresponding wheel 18 of an automobile 20 supported by the platform 8,8', so stabilizing its position.

The purpose of the depression is also to restrict the overall vertical height of the platform plus automobile in that the platform itself has a certain height for obvious reasons of structural rigidity.

The front end of the runways 10 is in the form of a downwardaly inclined ramp to facilitate the ascent of the automobile 20 onto the respective platform. For this purpose the two platforms 8,8' are of different length, the upper platform 8 being longer than the lower platform 8', so that when these are in their completely lowered position (see FIG. 2) the two runways 10 of the upper platform 8 are superposed on the corresponding runways 10' of the lower platform 8', including at their inclined ramps.

The interior of each column 2, which is in the form of an H-shaped structural section, houses a hydraulic cylinder-piston unit 22, the rod 24 of which emerges upwardly and is provided with a deviation pulley 26 for a chain 28 which is fixed at one end to the relative column 2 and at its other end to the carriage 12' of the lower platform 8'. The interior of each column 2 also houses two cylinder-piston units 30 of horizontal axis, their rod 32 emerging from the facing flange of the column to form a type of latch engagable in a bush 34 provided on the corresponding carriage 12,12' which slides along said column. For this purpose the end of the rod 32 is mushroom-shaped with its head tapering frontwards and of diameter less than the bore diameter of the bush 34.

The two hydraulic cylinder-piston units 22 and the four cylinder/piston units 30 are fed by a central hydraulic unit 36, which in the drawings is shown separate from the columns 2 but could be incorporated into one of them.

The central unit 36 is preferably controlled by a microprocessor which also operates a plurality of indicating, control and safety members to ensure overall correct operation of the installation of the invention, which operates as follows:

when in its rest state (see FIG. 2) the lower platform 8' rests on the ground and the upper platform 8 rests on the lower platform 8' and is ready to receive an automobile 20, which is made to rise along the two runways 10 of said upper platform 8 until its two from wheels 18 reach the depression 16 provided in the runways.

After the driver has descended from the automobile, the operator operates the central unit to cause oil to be fed into the two cylinder-piston units 22 which the result that the lower platform 8' rises together with the upper platform 8 supported by it. The upward movement of the two platforms 8,8' stops when the bushes 34 on the upper carriages 12 face the two upper cylinder-piston units 30, an automatic command then being fed to these to cause their rods 32 to extend until the upper platform 8 is locked to the columns 2.

The oil is then discharged from the cylinder-piston units 22 with the result that because of the particular mushroom shape of the head of the rods 32 the bushes 34 remain securely engaged by these whereas the lower platform 8' descends to ground level to receive a second automobile, which is made to rise onto the runway 10' in the manner heretofore described.

When the automobile 20' has also reached its stable position on the platform 8', a new automatic command fed to the cylinder-piston units 22 causes this platform to rise until the rods 32 of the cylinder-piston units 30 face the bushes 34', of its carriages 12', to enable the rods 32', to extend and mechanically look said platform 8' in the position reached (see FIG. 3).

When in this configuration a third automobile can be positioned below the platform 8', the installation of the invention hence allowing three overlying automobiles to be parked (see FIG. 1).

Theoretically, more than two platforms could be provided; however as their number increase, the stability of the framwork has to be ensured by other expedients, such as over-dimensioning of its components or a different method of fixing to the ground.

Figure 5:
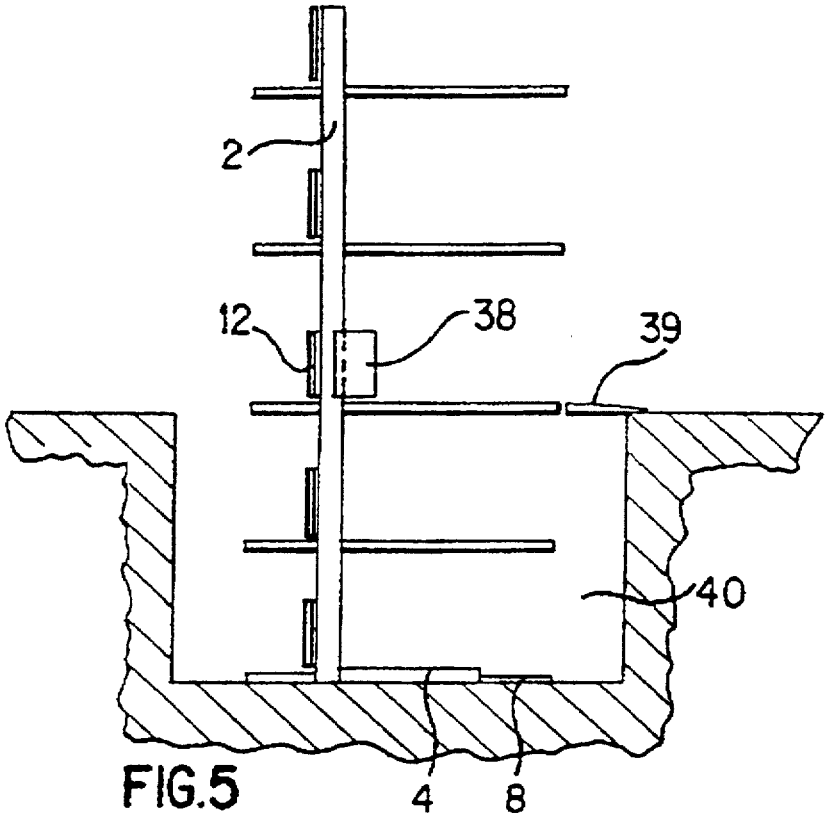
FIG. 5 shows a different embodiment in the same view as FIG. 3.
Figure 6:
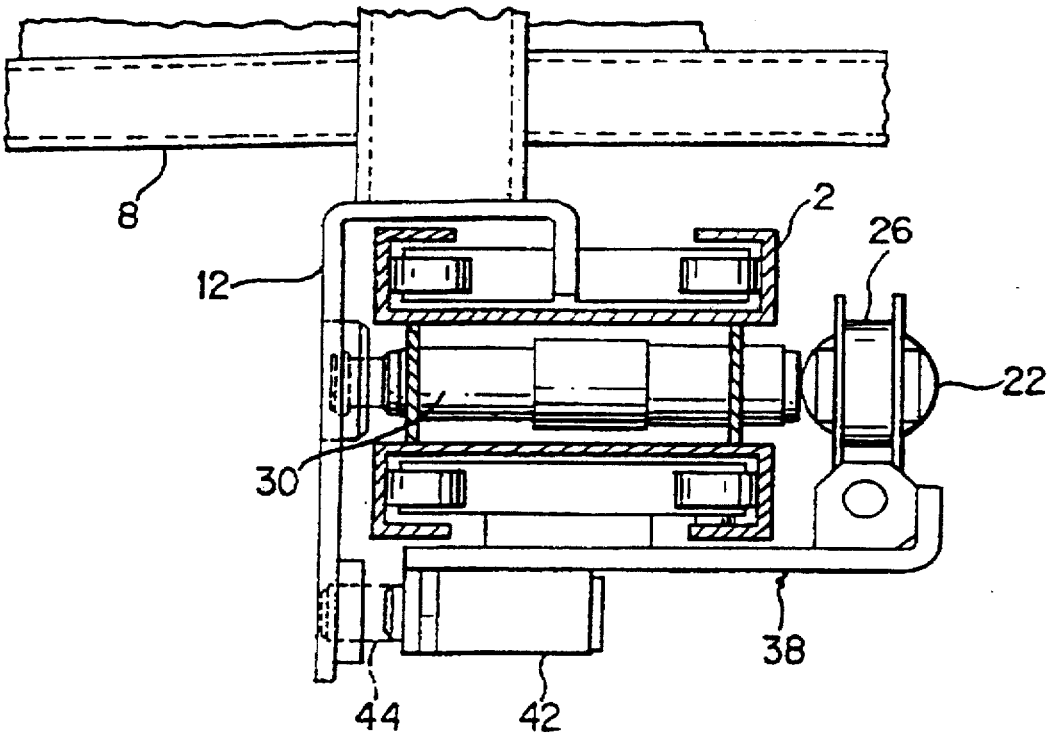
FIG. 6 shows an enlarged horizontal section through a part of the column.

In the embodiment shown in FIGS. 5 and 6 the framework of the installation according to the invention extends not only above ground but also below ground. In this case instead of moving all the platforms by utilizing the movement of one of them, it is preferable to achieve this movement by a pair of motorized carriages 38 slidable along the columns 2 and able to engage one or more platforms 8,8' to move them into the correct position and then look them in that position to the columns.

In this embodiment the platforms 8,8' have the same length and ramps 39 are removably engageable with them.

For this purpose the two columns 2 are partly housed in a pit 40 and partly project above ground level. The two carriages 38 are moved along the outside of these columns under the control of the two hydraulic cylinder-piston units housed within them, and are provided with two cylinder-piston units 42 the rods 44 of which are able to engage corresponding bushes provided on the sides of the carriages 12,12'. As in the preceding case, cylinder-piston units 30 are again provided within the columns 2 to look the platforms 8 at the predetermined heights along the columns.

In this embodiment the operating principle is substantially analogous to the preceding, except for the different operating sequence imposed by the fact that the frame extends in two vertically opposite directions about the automobile access level.

In practice the microprocessor controlling the operating cycle sets one platform at ground level and all all the others (four) superposed one on the other at a level such as to allow an automobile to rise onto the platform positioned at ground level.

After the automobile has risen onto this platform, the two motorized carriages 38 engage it and move it to the lowest level, ie resting on the base of the pit 40, after which they engage the overlying platform and move it to ground level so that it is able to receive a second automobile.

After this has risen onto the platform and has been lowered together with it into the pit, the carriages 38 engage the entire remaining stack of platforms 8 and position the upper one at ground level.

The operation then continues as in the preceding case, so that the various automobiles gradually become positioned on the various platforms starting from the most distant.

The various automobiles are removed from the installation according to the invention in the reverse sequence, under the control of the microprocessor.

From the aforegoing it is apparent that the parking installation according to the invention is particularly advantageous in that because of its constructional simplicity, its small overall size and the reduced number of components, it solves the problem of small-scale parking in an effective, economical, space saving and operationally simple manner.

I claim:

1. A multiple vehicle parking installation comprising:

a central unit for controlling operation of said installation;

a pair of vertical columns;

a plurality of horizontal platforms, each suitable for accommodating individual vehicles, each of said plurality of horizontal platforms being provided with means for vertically sliding along said pair of vertical columns;

carriage means controlled by said central unit, said carriage means being vertically slidable along each of said pair of columns and selectively moving one of said plurality of horizontal platforms;

first mechanical locking means, comprising first elements mounted on said carriage means and second elements mounted on each of said plurality of horizontal platforms and cooperating with said first elements of said first mechanical locking means to releasably lock, when engaged, a corresponding one of said plurality of horizontal platforms to said carriage means;

second mechanical locking means, comprising primary elements mounted on said pair of vertical columns at pre-determined distances and secondary elements mounted on each of said plurality of horizontal platforms and cooperating with said primary elements to releasably lock, when engaged, a corresponding one of said plurality of horizontal platforms to said pair of vertical columns and to allow, when disengaged, sliding of said one of said plurality of horizontal platforms along said pair of vertical columns.

2. An installation as claimed in claim 1, wherein each of said plurality of horizontal platforms comprises a pair of runways joined together with a connecting crossmember.

3. An installation as claimed in claim 1, wherein said carriage means is provided with a vertical axis hydraulic cylinder-piston unit, a rod of which emerges upwardly and is provided with a chain deviated along a pulley, said chain being fixed at one end to one of said pair of vertical columns and at its other end to said carriage means.

4. An installation as claimed in claim 1, wherein said first mechanical locking means comprises at least a horizontal axis cylinder-piston unit with a cylinder mounted on said carriage means, a rod of which releasably engages a first corresponding bush provided in each of said plurality of horizontal platforms.

5. An installation as claimed in claim 1, wherein said second mechanical locking means comprises at least a horizontal axis cylinder-piston unit with a cylinder mounted on each of said pair of columns a rod of which releasably engages a corresponding bush provided in each of said plurality of horizontal platforms.

6. An installation as claimed in claim 1, wherein a front end of each of said plurality of horizontal platforms is provided with removable ramps.

* * * * *